US005174756A

United States Patent [19]

Taylor

[11] Patent Number: 5,174,756

[45] Date of Patent: Dec. 29, 1992

[54] APPARATUS FOR SIMULATING A SHARP EDGED WEAPON

[76] Inventor: Alan Taylor, P.O. Box 75, Theresa, N.Y. 13691

[21] Appl. No.: 809,873

[22] Filed: Dec. 18, 1991

[51] Int. Cl.[5] ..... A63H 33/30; A63H 65/02; F41B 13/00

[52] U.S. Cl. ..... 434/11; 446/473; 401/207; 273/57.3

[58] Field of Search ..... 446/267, 473, 475; 273/57.3; 434/11; 401/207

[56] References Cited

U.S. PATENT DOCUMENTS

| | | | |
|---|---|---|---|
| 1,276,959 | 8/1918 | Riebe . | |
| 2,002,598 | 5/1935 | Wood, Jr. | 401/207 |
| 2,294,026 | 8/1940 | Tuscan | 272/57 |
| 2,729,024 | 1/1956 | Guttmann | 446/276 X |
| 3,481,677 | 12/1969 | Abrahamson | 401/207 |
| 3,878,639 | 4/1975 | Scheelar et al. | 446/475 X |
| 4,892,303 | 1/1990 | Lohre | 272/98 |
| 4,944,531 | 7/1990 | Greeno | 446/473 X |

FOREIGN PATENT DOCUMENTS

| | | | |
|---|---|---|---|
| 235722A1 | 3/1985 | Fed. Rep. of Germany | 13/2 |
| 2578039A | 2/1985 | France | 13/2 |
| 1199255 | 12/1985 | U.S.S.R. | 273/57.3 |
| 829062 | 2/1960 | United Kingdom | 446/473 |

*Primary Examiner*—Gene Mancene
*Assistant Examiner*—L. Thomas
*Attorney, Agent, or Firm*—Heslin & Rothenberg

[57] ABSTRACT

A simulated sharp edged weapon includes a blade, an ink absorbing edge affixable to the edge of the blade, a handle attached to the blade, an ink reserve means, means for allowing ink to flow from the ink reserve means to the ink absorbing edge thereby allowing the ink absorbing edge to contain ink therein wherein the ink absorbing edge of the blade marks an area with ink upon contact therewith.

12 Claims, 2 Drawing Sheets

APPARATUS FOR SIMULATING A SHARP EDGED WEAPON

BACKGROUND OF THE INVENTION

1. Technical Field

The present device primarily relates to a device used in self-defense training, more particularly to an apparatus simulating a sharp edged weapon. 2. Description of the Prior Art Self defense and combat training are taught by a large variety of groups ranging from the military and law enforcement to self defense and martial arts schools. In combat or self defense training, defense from or use of a sharp edged instrument is a crucial part of such training. Today, most law enforcement and self defense schools use rubber knives or wooden sticks. The military uses a bayonet with a scabbard in place. These devices fail to mark where a strike was made, making it less realistic and more difficult for a judge or instructor to correct mistakes. Thus, there exists a need for a simulated weapon that is more realistic and capable of marking the location of any strike.

SUMMARY OF THE INVENTION

The aforementioned criteria are achieved through implementation of the simulated sharp edged weapon in accordance with the principles of the present invention. In one embodiment of the invention, the simulated sharp edged weapon comprises a blade, an ink absorbing edge affixable to an edge of the blade, a handle attached to the blade, an ink reserve means, means for allowing ink to flow from the ink reserve means to the ink absorbing edge thereby allowing the ink absorbing edge to contain ink therein wherein the ink absorbing edge of the blade marks are area with ink upon contact therewith. The blade may have a groove therein configured to receive the ink absorbing edge therein.

The ink reserve means may include a cavity within the handle. The simulated weapon may also include an ink supply means within the cavity of the handle.

The means for allowing ink to flow from the ink reserve means to the ink absorbing edge may include one or more ports placing the ink supply means in fluid flow relationship with the ink absorbing edge. The ink absorbing edge may include a felt-like material. The one or more ink ports may contain a sharp edge, protruding into the cavity of the handle, capable of puncturing the ink supply means.

The simulated weapon may also include a collar. The collar may have an upper section and a lower section. The sections may be attached to each other at a location where the blade is attached to the handle thereby securing the ink absorbing edge in place. A fastening means may be used to attach the sections together.

The ink supply means may include an ink cartridge and/or an ink absorbing material. The handle may include a removable cap wherein the removal of the cap exposes the cavity within the handle.

BRIEF DESCRIPTION OF THE DRAWINGS

The aforementioned features of the invention are more thoroughly described in the detailed description of the invention when read in conjunction with the drawings in which.

DETAILED DESCRIPTION OF THE INVENTION

The present invention allows for a more realistic simulated sharp edged weapon. The major components of the present invention may include a blade, an ink absorbing edge, a handle and an ink reserve means.

A blade 10 may be shaped to simulate the type of weapon that training demands. As shown in reference to FIG. 1, the blade 10 may be shaped to resemble a double edged knife. However, the blade 10 may be shaped to resemble any sharp edged weapon, examples being single edged knives, sabers, machetes, hatchets or butterfly knives. The blade 10 needs to be relatively stiff, yet flexible enough so as not to injure a person when a strike is made during training. Materials which easily lend themselves to various shapes yet have the proper rigidity will suffice, examples being rubber or plastic. Blade 10 will have a grooved edge. The groove 12 is shaped so as to be capable of holding an ink absorbing edge 20. Examples of such a groove are shown in FIGS. 2 and 3.

Figure 1:
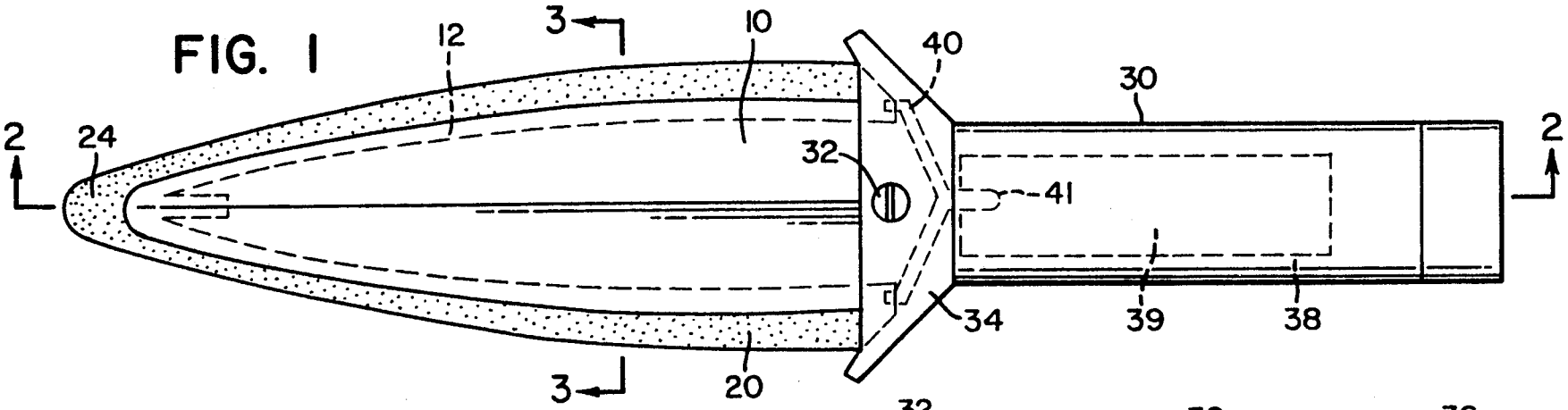
FIG. 1 is an elevational view of an apparatus for simulating a sharp edges weapon in accordance with the principles of the present invention.
Figure 2:
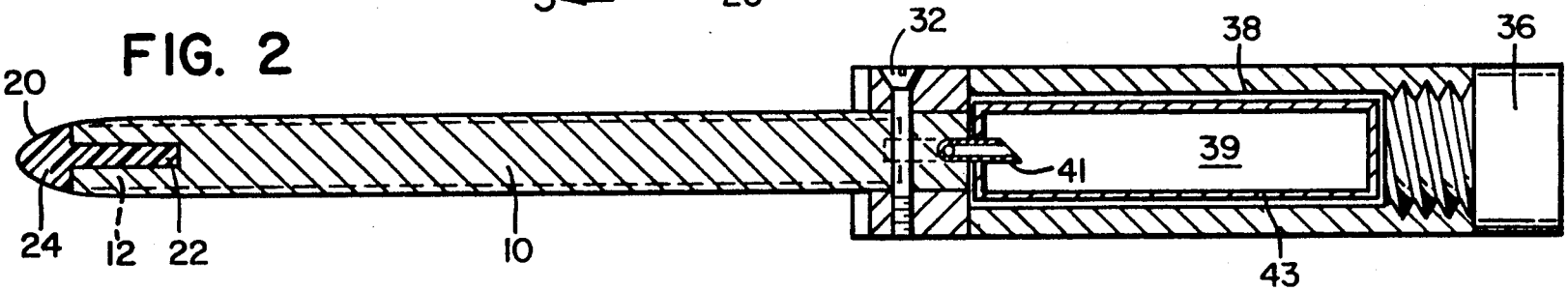
FIG. 2 depicts a sectional view of the apparatus for simulating a sharp edges weapon depicted in FIG. 1 taken along line 2—2.
Figure 3:
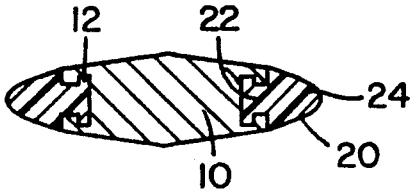
FIG. 3 depicts a sectional view of the apparatus for simulating a sharp edges weapon depicted in FIG. 1 taken along line 3—3.

The ink absorbing edge 20, has an inner side 22 that is shaped to slide within the groove 12 of the blade 10, as shown in FIGS. 2 and 3. The outer side 24, of said ink absorbing edge 20, is shaped in conjunction with the shape of blade 10 to substantially resemble the sharp edged instrument desired. This is clearly shown in FIGS. 1 and 3. The ink absorbing edge 20 may be made of any material that can absorb and retain ink, an example being felt. Further, since the ink absorbing edge 20 may be removable from the device, it may be replaced.

The blade 10, together with the ink absorbing edge 20, is attached to a handle 30. The handle 30 may be made of any solid material, such as plastic or metal. The blade 10 may be secured to the handle 30 by means of a hilt or collar 34 which may be held together by a screw 32, as shown in FIG. 2. However, the blade 10 may be secured to handle 30 by any well known means. The hilt or collar 34 also functions to secure, or clamp, the ink absorbing edge 20 to blade 10, as shown in FIG. 1.

The handle 30 may further contain a removable cap 36, at the end not engaged with said blade 10. The cap 36 is preferably sealed to the handle to prevent ink from leaking from the reserve means 38. An example of such a cap is shown in FIG. 2, and may comprise a screw-type cap. The inner portion of the handle 30 may be hollow to function as an ink reserve means 38. Although, an ink reserve means 38 may be located within the handle as shown in FIG. 2, it may be located elsewhere, such as within the blade 10. The ink reserve means 38 may also function to hold an ink supply means 39. The ink supply means 39 may be an ink cartridge 43 or any ink absorbing material such as a felt ink absorbing body. Alternatively, ink, in the liquid form, may be placed directly within the ink reserve means 38 which has a liquid tight seal with the cap.

Figure 4:
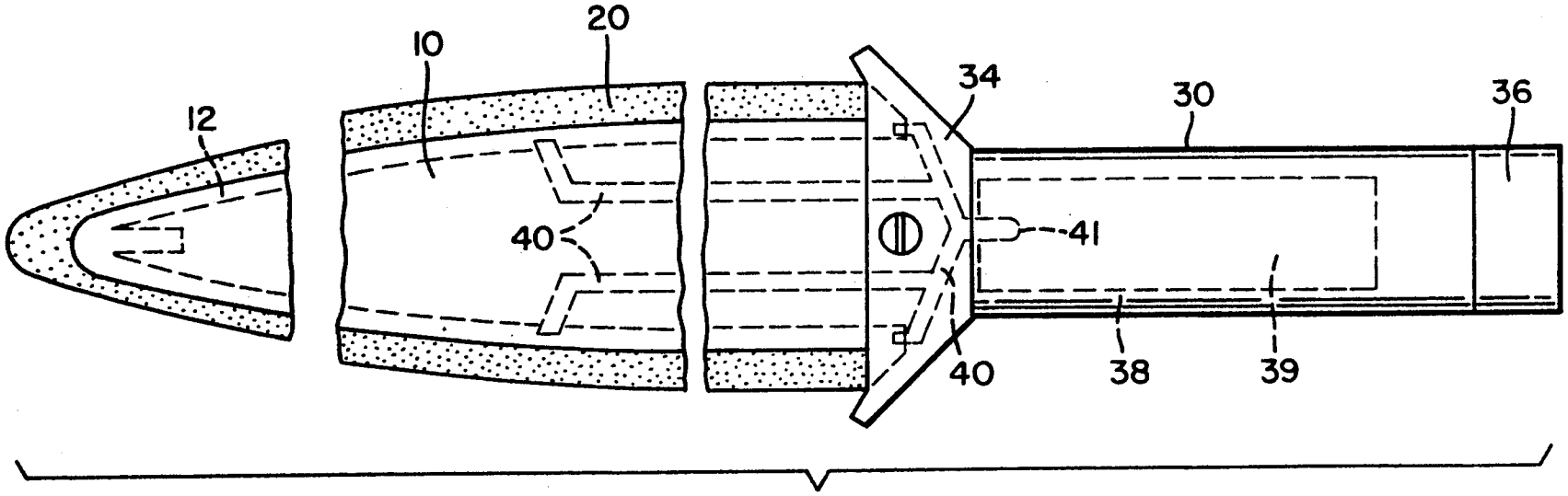
FIG. 4 is a sectional view of yet another embodiment of the apparatus for depicting a sharp edges weapon.

In order to be capable of marking a strike, the ink within the ink reserve means 38 must reach the ink absorbing edge 20. This may be accomplished by an ink feeder port 40, as shown in FIG. 4. The ink feeder ports may be contained within the collar 34, the handle 30 or both. The ink feeder port 40 should extend within the handle 30 into the ink reserve means 38 in such a manner as to penetrate an ink supply means 39 within the handle 30. The ink feeder port 40 may have a sharp edge 41 protruding into the ink reserve means 38 which is capable of puncturing the ink supply means 39. The ink ports 40 may contact the ink absorbing edge 20 solely at the portion secured by the hilt 34. However, as shown in FIG. 4, the ink ports 40 may contact the ink absorbing edge at a multitude of points by having additional ink feeder ports 40 extending within the blade 10. The necessity of additional feeder ports within the blade will depend upon the length and shape of the blade 10 and the desired intensity of markings by the ink absorbing edge 20. The ink absorbing edge 20 will become saturated with the ink fed thereto by the ports 40.

The ink used within this device should, preferably, be a non-toxic and non-staining. Ink of any color may be used with the present invention.

The invention may further comprise of a scabbard. A cover jr scabbard that can effectively cover the invention so as to prevent evaporation of the ink and further protect the knife and clothing may be desired. An example of such a scabbard, would be one of hard plastic with a click-lock design, as is well known in the art. It may be preferable to match the color of the scabbard with that of the ink used so any marks created are not seen. Furthermore, a scabbard capable of holding an extra ink cartridge or ink reserve means would be advantageous.

The present invention may be used by removing the simulated sharp edged weapon from the scabbard, and then simply using it as one would an actual sharp edged weapon. When the ink absorbing edge 20 comes in contact with an opponent, it will leave an ink mark, thereby showing the position and extent of contact an actual sharp edge would have made. When the exercise and training is completed, the simulated sharp edged weapon may be re-inserted into the protective scabbard.

While the present invention has been described in connection with the embodiments depicted herein, the invention is not limited to these embodiments. Other modifications and changes will be apparent to those skilled in the art, and are intended to be within the scope of the invention as defined by the following claims.

What is claimed is:

1. A simulated sharp edged weapon comprising:

a blade;

an ink absorbing edge affixable to an edge of the blade;

a handle attached to the blade;

an ink reserve means;

means for allowing ink to flow from the ink reserve means to the ink absorbing edge thereby allowing the ink absorbing edge to contain ink therein wherein the ink absorbing edge of the blade marks an area with ink upon contact therewith.

2. The simulated weapon of claim 1 wherein the ink reserve means comprises a cavity within the handle.

3. The simulated weapon of claim 2 further comprising an ink supply means within the cavity of said handle.

4. The simulated instrument of claim 1 wherein the means for allowing ink to flow from the ink reserve means to the ink absorbing edge comprises one or more ports, said ports placing the ink supply means in fluid flow relationship with the ink absorbing edge.

5. The simulated weapon of claim 1 wherein the ink absorbing edge comprises a felt-like material.

6. The simulated weapon of claim 1 wherein the blade edge comprises a groove therein, said groove being configured to receive the ink absorbing edge therein.

7. The simulated weapon of claim 1 further comprising a collar.

8. The simulated weapon of claim 1 wherein the collar comprises an upper section and a lower section, said sections being attachable to each other, by a fastening means, at a location where the blade is attached to the handle thereby securing the ink absorbing edge in place.

9. The simulated weapon of claim 3 wherein the ink supply means comprises an ink cartridge.

10. The simulated weapon of claim 3 wherein the ink supply means comprises an ink absorbing material.

11. The simulated weapon of claim 9 or 10 wherein the one or more ink ports comprise a sharp edge protruding into the cavity of the handle capable of puncturing the ink supply means.

12. The simulated weapon of claim 2 wherein the handle further comprises a removable cap wherein the removal of the cap exposes the cavity within the handle.

* * * * *